US006454458B1

(12) United States Patent
Born et al.

(10) Patent No.: US 6,454,458 B1
(45) Date of Patent: Sep. 24, 2002

(54) TIMEPIECE INCLUDING MEANS FOR INDICATING THE ANGULAR POSITION OF COAXIAL ANALOGUE DISPLAY INDICATORS

(75) Inventors: Jean-Jacques Born, Morges (CH); Pierre-André Farine, Neuchâtel (CH)

(73) Assignee: Asulab S.A., Bienne (CH)

( * ) Notice: Subject to any disclaimer, the term of this patent is extended or adjusted under 35 U.S.C. 154(b) by 0 days.

(21) Appl. No.: 09/564,859

(22) Filed: May 4, 2000

(30) Foreign Application Priority Data

May 6, 1999 (CH) ..... 0851/99

(51) Int. Cl.[7] ..... G04C 9/00; G04B 19/04

(52) U.S. Cl. ..... 368/185; 368/187; 368/76; 368/80

(58) Field of Search ..... 368/76, 80, 72–74, 368/181, 185–187, 250, 272, 273, 238

(56) References Cited

U.S. PATENT DOCUMENTS

| | | | | |
|---|---|---|---|---|
| 4,645,357 A | * | 2/1987 | Allgaier et al. | 368/187 |
| 5,231,612 A | * | 7/1993 | Allgaier et al. | 368/187 |
| 5,285,427 A | * | 2/1994 | Vaucher | 368/185 |
| 5,640,007 A | * | 6/1997 | Talbott et al. | 250/231.15 |
| 5,734,474 A | | 3/1998 | Haecker et al. | |
| 5,898,644 A | * | 4/1999 | Ganter et al. | 368/187 |
| 5,999,495 A | * | 12/1999 | Hashizume et al. | 368/80 |
| 6,130,425 A | * | 10/2000 | Sano | 250/231.15 |
| 6,307,814 B1 | * | 10/2001 | Farine et al. | 368/80 |
| 6,330,207 B1 | * | 12/2001 | Born et al. | 368/76 |

FOREIGN PATENT DOCUMENTS

| | | |
|---|---|---|
| DE | 195 24 030 | 11/1996 |
| EP | 721 154 | 6/1996 |
| FR | 1 512 207 | 4/1968 |
| WO | 97 45 705 | 12/1997 |

* cited by examiner

*Primary Examiner*—Vit Miska
*Assistant Examiner*—Jeanne-Marguerite Goodwin
(74) *Attorney, Agent, or Firm*—Sughrue Mion, PLLC

(57) ABSTRACT

A first (5) of the indicators and a first pipe (1) form part of an angular position indicating moving part (MR1) carrying a plate (9) co-operating with a first sensor (11) for generating a position signal for said indicator as a result of discontinuities in the material of said plate.

A second display indicator (6) coaxial to said first indicator is coupled to a second angular position indicating moving part (MR2). The latter, which is mounted at a distance from the first moving part, is in a meshing relationship with a second pipe (2) carrying said second indicator. This second moving part carries a second plate (18) co-operating with a second sensor (20), for generating a position signal for said second indicator as a result of discontinuities in the material of said second plate.

The plates (9, 18) and the sensors (11, 20) can thus be arranged respectively side by side thus reducing the height to the superposition of one plate and one sensor only to indicate independently the angular positions of the first and second indicators.

20 Claims, 3 Drawing Sheets

TIMEPIECE INCLUDING MEANS FOR INDICATING THE ANGULAR POSITION OF COAXIAL ANALOGUE DISPLAY INDICATORS

BACKGROUND OF THE INVENTION

The present invention relates to a timepiece including a clockwork movement, provided with an analogue display including at least two rotating display indicators attached to respective coaxial pipes and means for indicating the angular position of said indicators.

In the case of a timepiece configuration of this type, it may be desirable to have information as to the angular position of two of these coaxial indicators, or even more. In particular, the invention concerns identification of the angular position of each indicator by a rotating plate superposed with a magnetic or capacitive sensor.

To achieve this, it is necessary to associate, with each coaxial mobile part carrying an indicator, an indicating element co-operating with a sensor sensitive to its movement and capable of generating the desired angular position signal. If the problem of implanting such a sensor is relatively easy to resolve when there is only one display indicator, this is not the case when one has to indicate the angular position of two or more display indicators rotating about the same axis. Indeed, in this case, the sensors must a priori be located in proximity to as many indicating plates superposed and respectively mounted on the coaxial pipes of the indicators. Such an arrangement means arranging the sensors on different levels which is are liable to occupy significant height, thereby increasing that of the clockwork movement. Such an arrangement would also complicate the connection of the sensors to an electronic circuit for processing the angular measurement signals.

SUMMARY OF THE IN INVENTION

The object of the invention is to provide a timepiece of the type defined in the preamble, wherein several coaxial display indicators can be associated with means capable of providing data as to their respective angular position, while resolving the problems which have just been listed.

The invention therefore concerns a timepiece as defined by the claimed features.

As a result of these features, the presence of several sensors, associated with as many coaxial indicators, does not increase the height of the timepiece, which remains substantially the same as that which one would have with indication by a single indicator rotating about a given axis. Moreover, it becomes possible to arrange the position indicating plate at a first level and the sensors at a second level, so that any increase in height necessary for indicating the respective angular positions of the coaxial indicators remains that of a single sensor. Furthermore, since the sensors are preferably located on the same level, the whole of the connection can also be made on the same level, i.e. that of the sensor base.

BRIEF DESCRIPTION OF THE DRAWINGS

Other features and advantages of the invention will appear from the following description given solely by way of example and made with reference to the annexed drawings in which.

In all the Figures, only the parts of the timepiece necessary for understanding the embodiments and variants shown have been illustrated.

Figure 1:
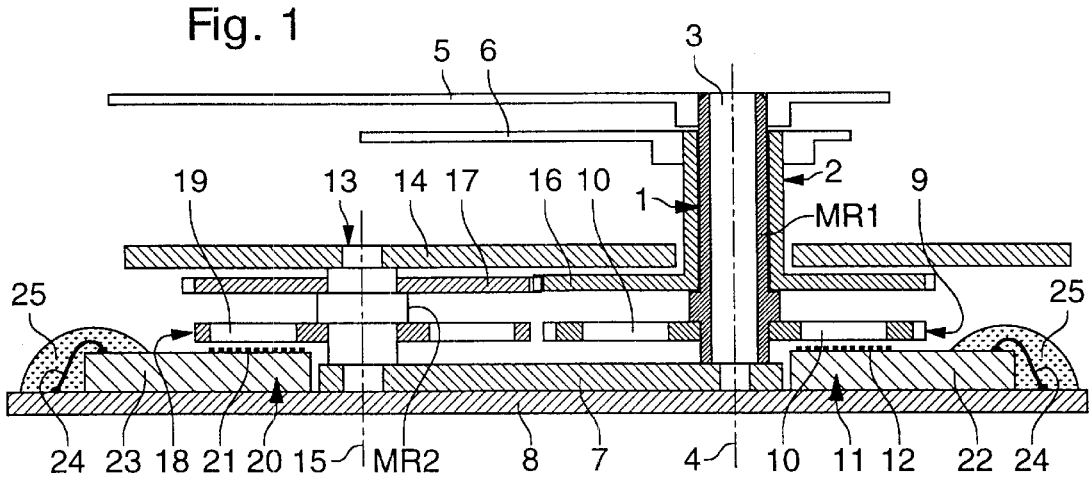
FIG. 1 is a partial cross-section of a first embodiment of a timepiece according to the invention.
Figure 2:
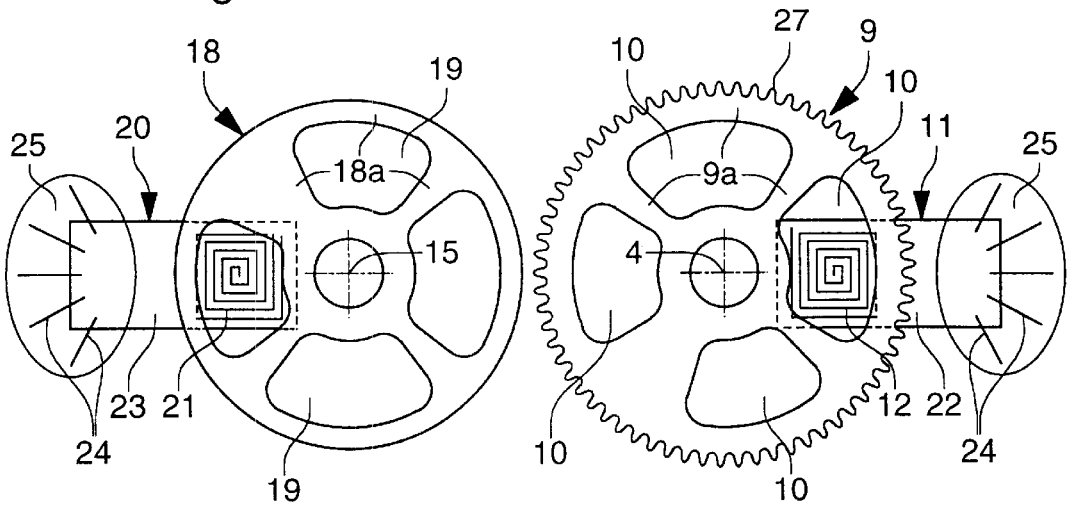
FIG. 2 is a partial schematic plan view of this first embodiment.

Reference will be made first of all to FIGS. 1 and 2 which show a first embodiment of the timepiece according to the invention. It includes a minute pipe 1 and an hour pipe 2 mounted coaxially, in a conventional manner, on a common shaft 3 having an axis 4. Rotating indicators for the minutes 5 and hours 6 are respectively driven onto pipes 1 and 2.

Of course, indicators 5 and 6 may also indicate other variables such as the seconds, chronometric data, the date etc. One may also envisage providing, in a coaxial position, more than two display indicators, all provided with means for indicating their angular position designed in accordance with the invention.

In the present example, shaft 3 is driven into a bridge 7 of the timepiece movement, this bridge being applied here against a plate 8 which is preferably an insulating substrate advantageously able to carry a printed circuit connecting the electric and electronic components of the timepiece to each other. Its timekeeping circuit (not shown) may be arranged thereon.

Minute pipe 1 carries a first plate 9 for indicating its angular position arranged perpendicular to axis 4. In the case shown here, this plate includes four openings 10, distributed with an angular offset of 90° between them. As is visible in FIG. 2, these openings 10 are separated by arms of material 9*a*. Thus, minute pipe 1 and its associated plate 9 together form a first position indicating moving part, to which the reference MR1 has been allocated, and which contributes to providing data as to the position of minute indicator 5.

DETAILED DESCRIPTION OF THE INVENTION

This timepiece also includes a first sensor 11 of the magnetic or capacitive type. It is placed in proximity to plate 9 and includes a detection element 12. This latter is placed below plate 9 perpendicular to a zone in which openings 10 and arms of material 9*a* of the plate separating the openings from each other alternately rotate. The alternating presence of openings 10 and arms of material 9a above detection element 12, is capable of causing a signal to be generated representative of the angular position of the latter in particular for the presence of a wider arm. In the case shown, it is assumed that detection element 12 is an induction coil sensitive to variations in the electromagnetic properties of plate 9, when it rotates about axis 4. It can thus be seen that plate 9 has at least one discontinuity of material capable of being detected by sensor 11, upon the rotation of moving part MR1 with respect to sensor 11, to provide a first measurement signal representative of an angular position of display indicator 5.

The timepiece according to the invention also includes a second position indicating moving part MR2 mounted at a distance from moving part MR1. The latter includes a trunnion 13 rotatably mounted in bridge 7 and in a plate 14 of the timepiece, about an axis 15.

Hour pipe 2 meshes via its plate 16 with a drive plate 17 riveted onto trunnion 13 and, consequently, attached in rotation to hour indicator 6. The meshing ratio between plate 16 driven by hour pipe 2 and drive plate 17 is preferably 1:1.

A second angular position indicating plate 18 is also riveted onto trunnion 13 in a position perpendicular to axis 15. In the example described, this plate 18 has an identical shape to plate 9 with the exception of the toothing, and thus has openings 19 separated by radial arms of material 18*a*. It will be noted however, that it is not imperative that the shape and diameter of the two plates 9 and 18 are identical.

Thus, the second position indicating plate MR2 contributes to providing data as to the position of indicator 6 in association with a second sensor 20 placed in proximity to second plate 18 and including a detection element 21. The latter is placed below plate 18, perpendicular to a zone in which openings 19 and arms of material 18*a* separating the openings from each other alternately rotate. The alternate passage of openings 19 and arms of material 18*a* above sensor 20 is capable of causing said sensor 20 to generate a signal representative of the angular position of moving part MR2 and consequently hour indicator 6. In the embodiment shown, the detection element is an induction coil sensitive to the electromagnetic variations in plate 18, when it rotates about axis 15. It is thus seen that second plate 18 includes at least one discontinuity of material capable of being detected by second sensor 20 when moving part MR2 rotates with respect to the sensor, to provide a second signal representative of an angular position of second display indicator 6.

As described in particular in these Patent Applications, sensors 11 and 20 may be of the inductive type (as shown here) or the capacitive type. Plates 9 and 18 are shaped in such a way and made of a material such that their movements with respect to the sensor generate respectively variations in at least one parameter thereof, these variations generating the aforecited position signals. This general formulation implies that numerous possibilities for making plate-sensor pairs are possible within the scope of the present invention, these possibilities resulting in particular for those skilled in the art from the aforecited Patent Applications and U.S. patent. The description of these numerous variants is thus not repeated here.

Each of detection elements 12 and 21 is mounted on a substrate 22 and 23 also carrying, for example in the form of an integrated circuit, the electronic processing means for the signal provided by the associated detection element 12 or 21. In this case, substrates 22 and 23 are made of a semiconductor material. If, as in the embodiment shown in FIGS. 1 and 2, detection elements 12 and 21 are flat coils, they are preferably formed by metal deposition on their respective substrates 22 and 23. Moreover, each of them can include connection wires 24 leading to another electronic processing circuit arranged in the timepiece, including in particular the timekeeping circuit. Drops of adhesive material 25 can partially, or preferably entirely, cover these wires.

Advantageously, position indicating plates 9 and 18 and their associated sensors 12 and 21 are respectively arranged in two superposed planes parallel to substrate 8. Thus, the height occupied by the assembly of the two plate-sensor pairs is limited to that of a single such pair, as opposed to an arrangement wherein the two assemblies are superposed along axis 4, in particular with a sensor arranged between plates 9 and 16.

According to various construction variants which can be envisaged, in addition to its position indicating function, moving part MR2 can also be allocated the function of transmitting force to associated indicator 6 in the clockwork movement itself.

For example, according to a first of these variants, plate 18 of moving part MR2 can form part of a motor gear train of the timepiece (or be driven directly by a motor) to assure the transmission of the movement to plate 16 of hour pipe 2. In this case, plate 18 has a toothing.

According to a second variant, the transmission of force can be assured by driving plate 17 of moving part MR2, in this case forming part of the gear train of the timepiece. The toothing can then be omitted from plate 18.

According to a third variant, plate 16 of hour pipe 2 can be driven directly by a motor gear train (or by a motor) of the timepiece and in turn drive moving part MR2 via plate 17. In this case, moving part MR2 is an additional moving part dedicated solely to indicating the angular position of indicator 6.

If a drive force is applied to moving part MR2 by plate 9, the latter includes a toothing 27. However, in a variant, minute pipe 1 can be driven for example by a pinion located above or below plate 9.

Finally it is also possible, in similar configurations to the above second and third variants, to provide only one toothed plate provided with openings on moving part MR2, meshing both with plate 16 and with the gear train of the clockwork movement to act as movement transmission member and as position indicating element. Naturally, in this case, substrate 23 must be located a little higher than substrate 22, which complicates the arrangement of the electronic parts and the connection of such parts.

A different meshing ratio between hour pipe 2 and moving part MR2 than 1:1 could be envisaged, the differences in the rotational speeds then having to be taken into account in the electronic processing means of sensors 11 and 20.

Those skilled in the art will also understand that there is nothing to prevent one or more other plate-sensor pairs associated with other coaxial indicators, such as a second indicator for example, being provided.

Figure 3:
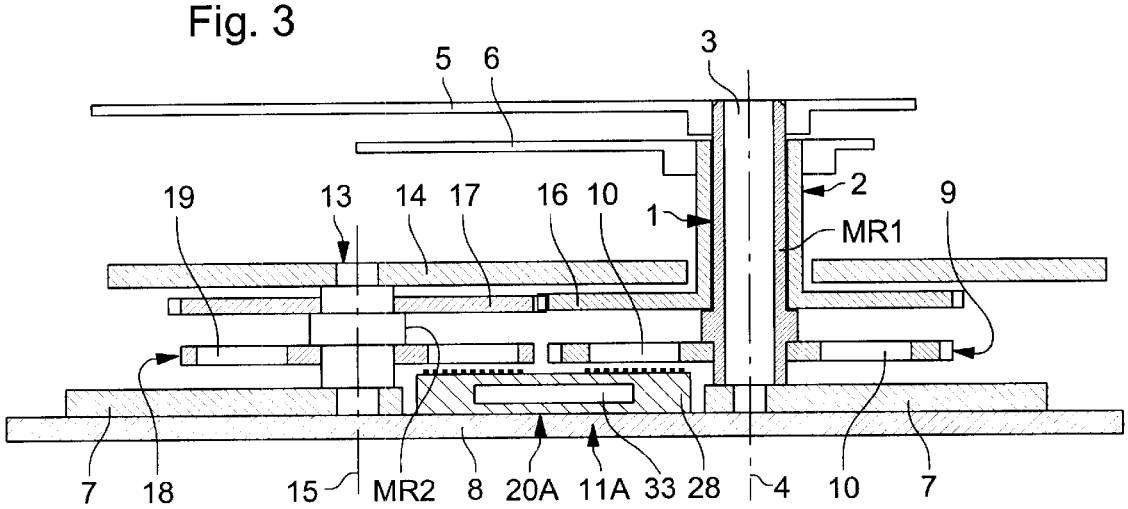
FIG. 3 shows a partial cross-section of a second embodiment of the timepiece according to the invention.
Figure 4:
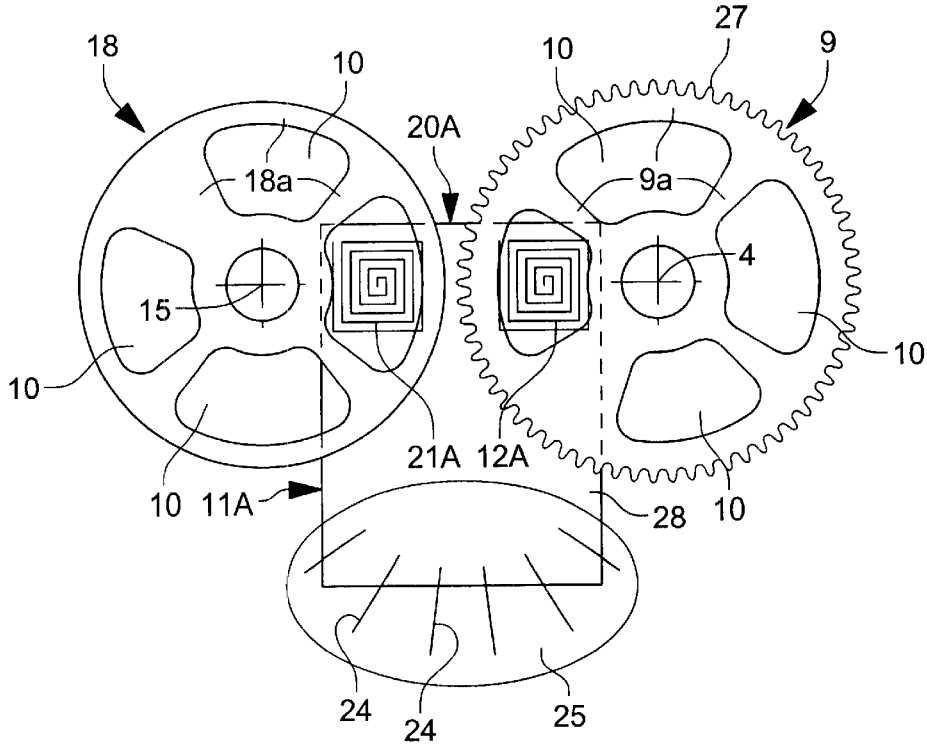
FIG. 4 is a partial schematic plan view of this second embodiment.

FIGS. 3 and 4 show another embodiment of the timepiece according to the invention differing from that of FIGS. 1 and 2 only in the arrangement of the detection elements and their associated circuits. The other components of the timepiece will not therefore be described again and bear the same references as in FIGS. 1 and 2.

Thus, sensors 11A and 20A include detection elements 12A and 21A which, in this example, also have the form of flat inductive coils. However, here the electronic circuits of the two sensors 11A and 20A are provided in the same semiconductor substrate 28. Preferably, these two circuits have a common part integrated in the substrate. In this case, it may also be advantageous to integrate in substrate 28 all the electronic components of the timepiece, including in particular the timekeeping circuit 33.

Figure 5:
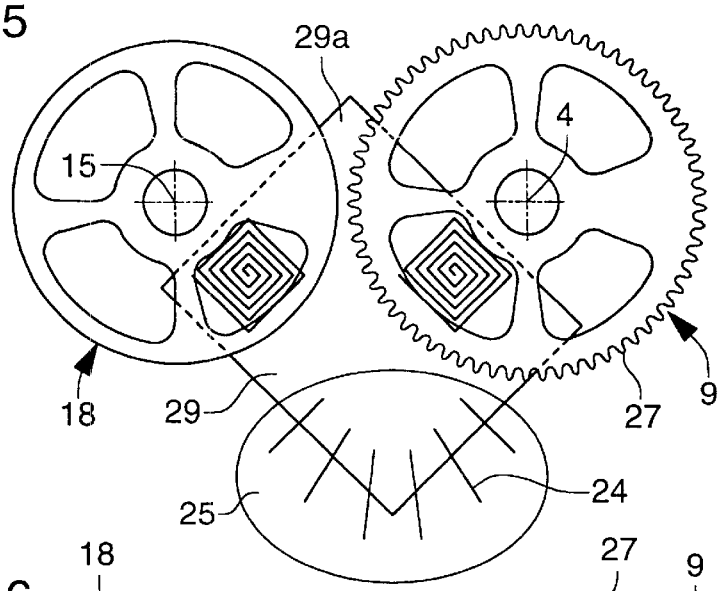
FIGS. 5 to 7 show several possible variants of the arrangement of the sensors with respect to the position identification moving parts.

Whereas in FIGS. 3 and 4, substrate 28 extends, via an end portion carrying detection elements 12A and 21A, between axes 4 and 15 of moving parts MR1 and MR2, in the variant of FIG. 5, a substrate 29 is provided extending via a corner portion 29*a* between axes 4 and 15, by being placed at an angle.

Figure 6:
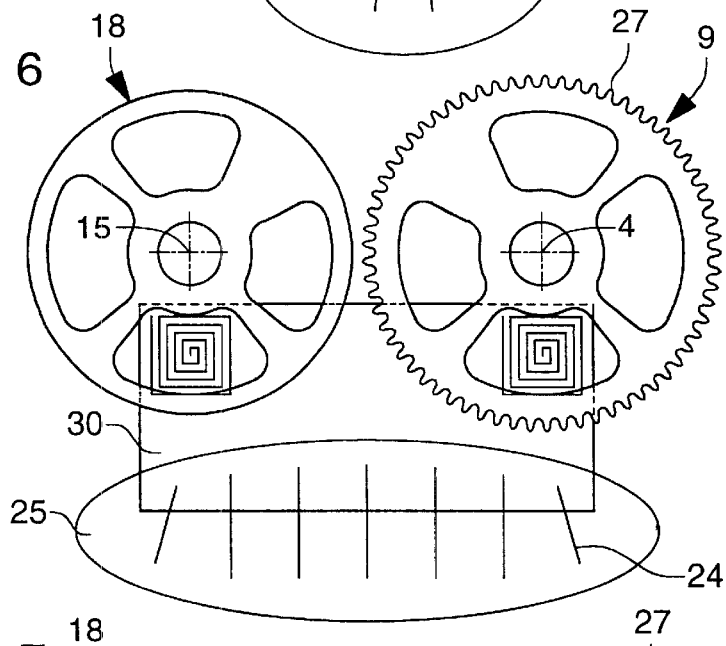

FIG. 6 shows a substrate 30 placed entirely on the same side with respect to axes 4 and 15, this variant being expensive given the large surface area of the semiconductor substrate necessary.

Figure 7:
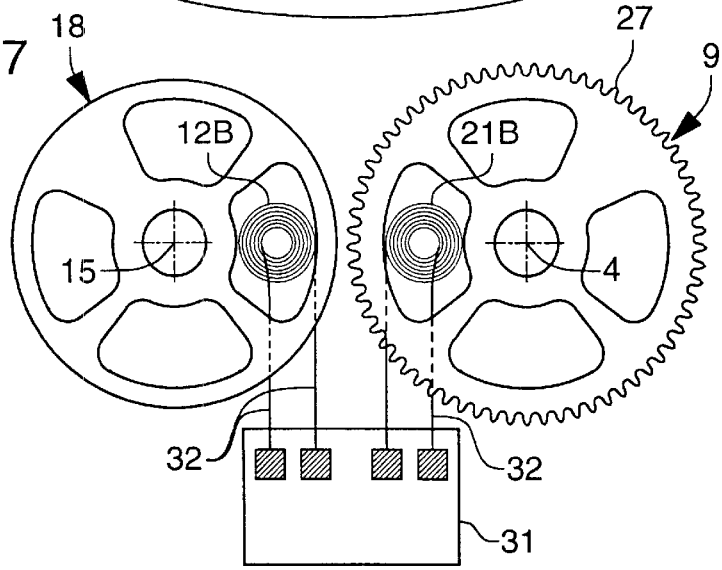

Finally in the variant of FIG. 7, only respective detection elements 12B and 21B are provided perpendicular to plates 9 and 18, for example distinct coils arranged either directly on a bridge or the plate of the timepiece, or on another support, these coils being connected to an electronic circuit 31 by wires 32, circuit 31 being provided at a distance from plates 9 and 18. Preferably, detection elements 12B and 21B are inductive coils formed by an electric wire including several turns increasing the detection sensitivity. This latter variant allows the thickness of the timepiece to be reduced to a minimum, while assuring a high level of detection sensitivity for the analogue indicator angular position indicating means at a low cost.

What is claimed is:

1. A timepiece including a clockwork movement, provided with an analogue display, including:

at least a first and a second coaxial rotating display indicator attached respectively to corresponding coaxial pipes mounted co-axially, a first angular position indicating moving part formed by a first of said pipes carrying a first plate perpendicular to its axis, also associated with said first moving part, a first magnetic angular position sensor for said first moving part and consequently of said first display indicator, said first plate having at least one discontinuity of material capable of being detected by said first sensor, when said first moving part rotates with respect to said first sensor, to provide a first measurement signal representative of an angular position of said first display indicator;

at least a second angular position indicating moving part for said second display indicator, said second moving part being mounted at a distance from said first moving part and in a meshing relationship with a second of said pipes, said second moving part carrying at least a second plate perpendicular to its axis; and also associated with said second moving part, a second magnetic sensor of the angular position thereof and consequently of the second display indicator, said second plate having at least one discontinuity of material capable of being detected by said second sensor when said second moving part rotates with respect to said second sensor, to provide a second measurement signal representative of an angular position of said second display indicator.

2. A timepiece according to claim 1, wherein said first and second plates are arranged in the same first plane, and wherein said first and second sensors include respectively position indicating elements placed in a second plane parallel to said first plane, below said first and second plates.

3. A timepiece according to claim 2, wherein said position indicating elements are each arranged at a surface of a distinct semiconductor substrate arranged on a common flat substrate.

4. A timepiece according to claim 3, including an electronic timekeeping circuit, wherein said timekeeping circuit is provided in one of said semiconductor substrate and said flat substrate at a surface of which is provided at least one of the position indicating elements.

5. A timepiece according to claim 2, wherein said position indicating elements are arranged at a surface of a common semiconductor substrate.

6. A timepiece according to claim 5, wherein said first and second sensors include respective measurement signal processing circuits having a common part integrated in said semiconductor substrate.

7. A timepiece according to claim 5, wherein said common substrate has a generally rectangular shape and is arranged in part between axes of said position indicating moving parts.

8. A timepiece according to claim 7, wherein the part of said substrate arranged between said axes is a corner portion of said substrate.

9. A timepiece according to claim 5, wherein said common substrate is arranged a same side of axes of said first and second position indicating moving parts.

10. A timepiece according to claim 2, wherein said position indicating elements are arranged on a timepiece plate, a bridge or another support of said timepiece, and wherein said sensors respectively include measurement signal processing circuits provided in a semiconductor substrate arranged at a location of said timepiece plate, of said bridge or of said other support which is at a distance from said plates.

11. A timepiece according to claim 1, wherein an outer pipe (2) of said coaxial pipes includes a transmission plate meshing with a drive plate forming part of said second position indicating moving part.

12. A timepiece according to claim 11, wherein said drive plate and said second plate are identical and are provided with an outer toothing meshing with a gear train of said clockwork movement.

13. A timepiece according to claim 11, wherein said transmission plate of said outer pipe is coupled to a gear train of said clockwork movement by driving said second position indicating moving part.

14. A timepiece according to claim 11, wherein said drive plate of said second position indicating moving part is coupled to a gear train of said clockwork movement.

15. A timepiece according to claim 11, wherein said second plate of said second position indicating moving part includes a toothing coupled to a gear train of said clockwork movement for the transmission of the driving force to said outer pipe via said drive plate.

16. A timepiece according to claim 1, wherein said coaxial pipes are respectively those of a minute and an hour of said clockwork movement.

17. A timepiece according to 1, wherein said first and second plates are arranged in a same first plane and wherein said first and second sensors include respectively position indicating elements placed in a second plane parallel to said first plane, above said first and second plates.

18. A timepiece including a clockwork movement, provided with an analogue display, including:

at least a first and a second coaxial rotating display indicator attached respectively to corresponding pipes mounted coaxially, a first angular position indicating moving part formed by a first of said pipes carrying a first plate perpendicular to its axis, also associated with said first moving part, a first capacitive angular position sensor for said first moving part and consequently of said first display indicator, said first plate having at least one discontinuity of material capable of being detected by said first sensor, when said first moving part rotates with respect to said first sensor, to provide a first measurement signal representative of an angular position of said first display indicator;

at least a second angular position indicating moving part for said second display indicator, said second moving part being mounted at a distance from said first moving part and in a meshing relationship with a second of said pipes, said second moving part carrying at least a second plate perpendicular to its axis; and also associated with said second moving part, a second capacitive sensor of the angular position thereof and consequently of the second display indicator, said second plate having at least one discontinuity of material capable of being detected by said second sensor when said second moving part rotates with respect to said second sensor, to provide a second measurement signal representative of an angular position of said second display indicator.

19. A timepiece according to 18, wherein said first and second plates are arranged in a same first plane, and wherein said first and second sensors include respectively position indicating elements placed in a second plane parallel to said first plane, below said first and second plates.

20. A timepiece according to 18, wherein said first and second plates are arranged in a same first plane, and wherein said first and second sensors include respectively position indicating elements placed in a second plane parallel to said first plane, above said first and second plates.

* * * * *